US010105860B2

(12) United States Patent
Holtgreive

(10) Patent No.: US 10,105,860 B2
(45) Date of Patent: Oct. 23, 2018

(54) TOOL FOR CONTROLLED CUTTING

(71) Applicant: Joseph John Holtgreive, Waukegan, IL (US)

(72) Inventor: Joseph John Holtgreive, Waukegan, IL (US)

( * ) Notice: Subject to any disclaimer, the term of this patent is extended or adjusted under 35 U.S.C. 154(b) by 0 days.

(21) Appl. No.: 15/495,777

(22) Filed: Apr. 24, 2017

(65) Prior Publication Data

US 2017/0225346 A1 Aug. 10, 2017

Related U.S. Application Data

(63) Continuation of application No. 13/200,631, filed on Sep. 27, 2011, now abandoned.

(60) Provisional application No. 61/404,038, filed on Sep. 27, 2010.

(51) Int. Cl.
*B26B 29/06* (2006.01)
*B26F 1/38* (2006.01)

(52) U.S. Cl.
CPC ..... *B26B 29/06* (2013.01); *B26F 1/3853* (2013.01); *Y10T 83/7507* (2015.04); *Y10T 83/8821* (2015.04)

(58) Field of Classification Search
CPC ..... Y10T 83/8773; Y10T 83/7507; Y10T 83/8822; Y10T 83/8821; B26F 1/3853; B43L 13/20; B43L 13/201; B43L 13/203; B43L 13/205; B43L 13/206; B43L 13/208; B43L 13/22; B26D 829/06; B44C 7/025
USPC ..... 30/293–294, 290; 83/565, 455, 745, 83/466.1; 33/32.1–32.3, 32.7, 483–494, 33/562, 566; D10/64; D19/39–40
See application file for complete search history.

(56) References Cited

U.S. PATENT DOCUMENTS 1,909,780 A * 5/1933 McCann ..... B26F 1/3853 30/293
3,104,467 A * 9/1963 Lloyd-Young ..... C03B 33/04 33/42
3,406,456 A * 10/1968 Schleich ..... B26B 29/06 33/492
4,620,407 A * 11/1986 Schmid ..... E04G 23/02 156/98
4,879,157 A * 11/1989 Pankatz ..... E04B 1/7654 428/157
5,086,680 A * 2/1992 Johnson ..... B26D 1/205 83/167
5,287,625 A * 2/1994 Herron ..... B26B 29/06 269/265
5,471,755 A * 12/1995 Haskell ..... B26B 29/02 33/485
D390,078 S * 2/1998 Williams ..... D8/14
6,223,801 B1 * 5/2001 Mitchell ..... B44C 7/08 15/236.01
D616,317 S * 5/2010 Yeh ..... D10/71
(Continued)

*Primary Examiner* — Laura M Lee

(57) ABSTRACT

A Tool for making controlled cuts using a template cutting guide to facilitate the registration and cutting of a workpiece including, an elongated body portion having a top face and a bottom face separated by a thickness, a cutting guide slot sized to receive and control a cutting blade and extending through the thickness of the elongated body which may include guide lines with equidistant spacing. Additionally, the cutting guide may utilize push pins or fasteners to secure the cutting guide to the workpiece. The cutting guide allows the user to execute precise cuts in material such as mat board using a standard utility knife.

9 Claims, 9 Drawing Sheets

(56) References Cited

U.S. PATENT DOCUMENTS

| | | | | |
|---|---|---|---|---|
| 7,921,574 | B2 * | 4/2011 | Backstrom | B26B 29/06 33/482 |
| D670,181 | S * | 11/2012 | Allemand | D10/71 |
| 2005/0166732 | A1 * | 8/2005 | Valsoaney | B26B 29/06 83/19 |
| 2006/0191150 | A1 * | 8/2006 | Sikora, Jr. | B25H 7/00 33/566 |
| 2017/0165855 | A1 * | 6/2017 | Stevens | B26B 29/06 |

* cited by examiner

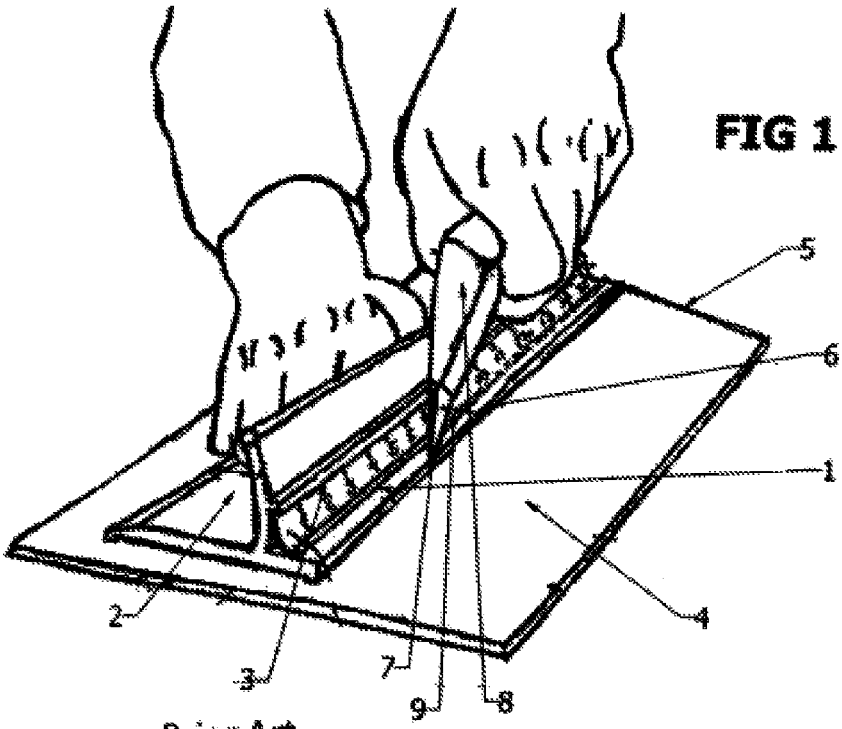
FIG 1
Prior Art
FIG 2
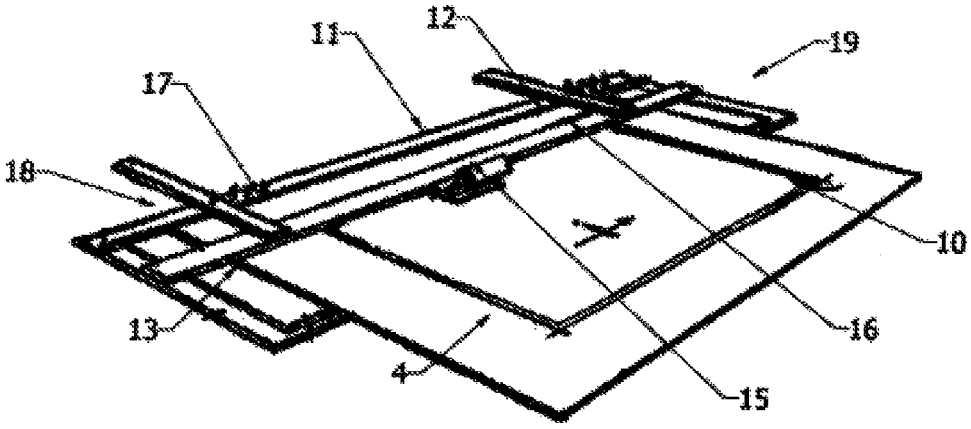
Prior Art

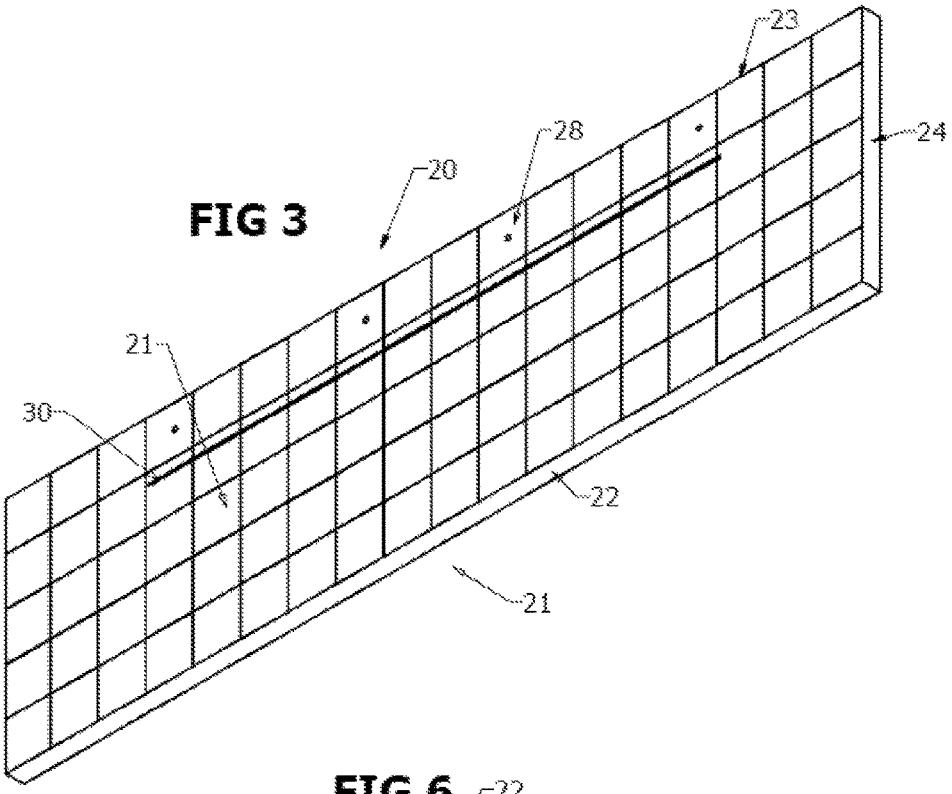
FIG 3
FIG 6
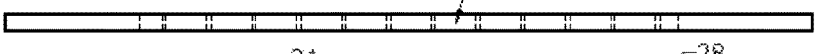
FIG 4
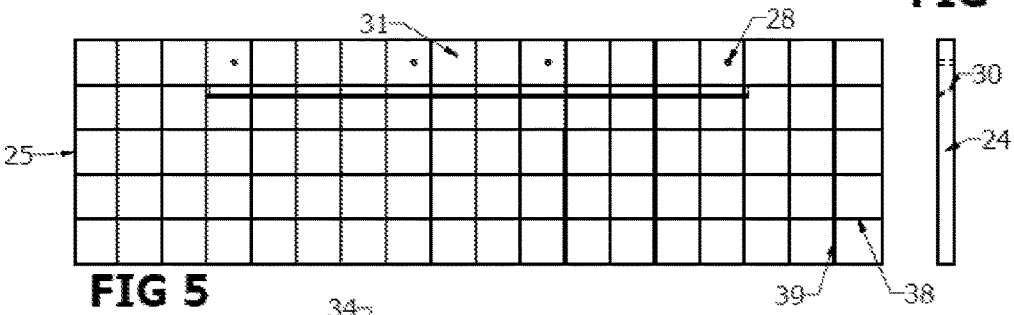
FIG 5
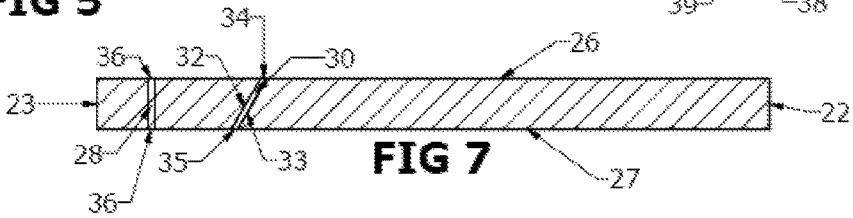
FIG 7

FIG 8
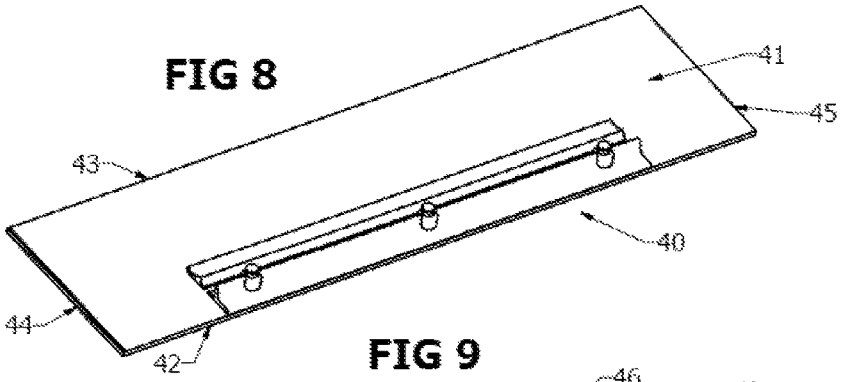
FIG 9
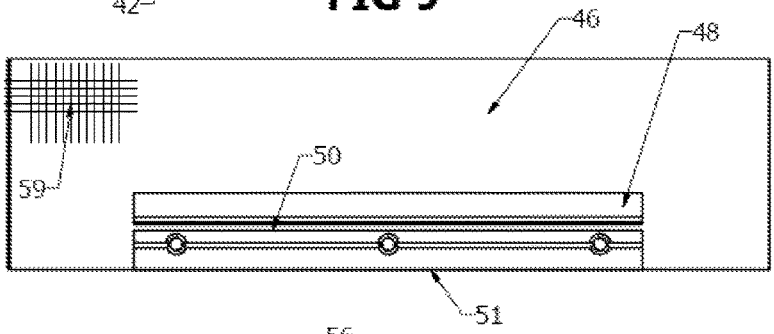
FIG 10
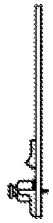
FIG 11
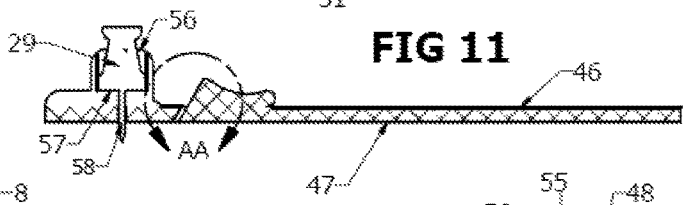
FIG 12
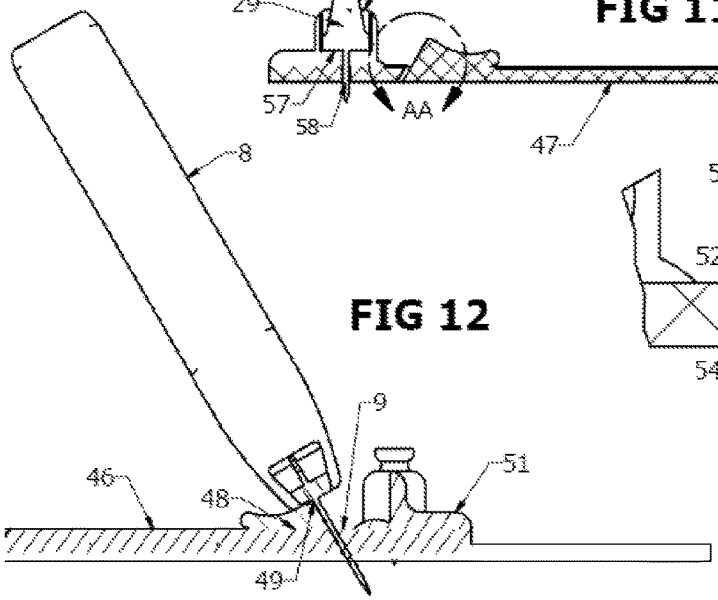
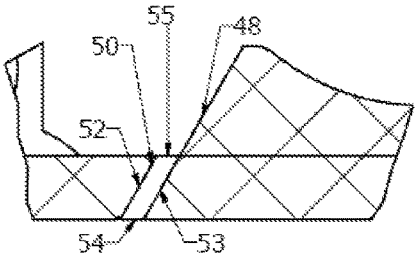
DETAIL AA
SCALE 4 : 1
FIG 13

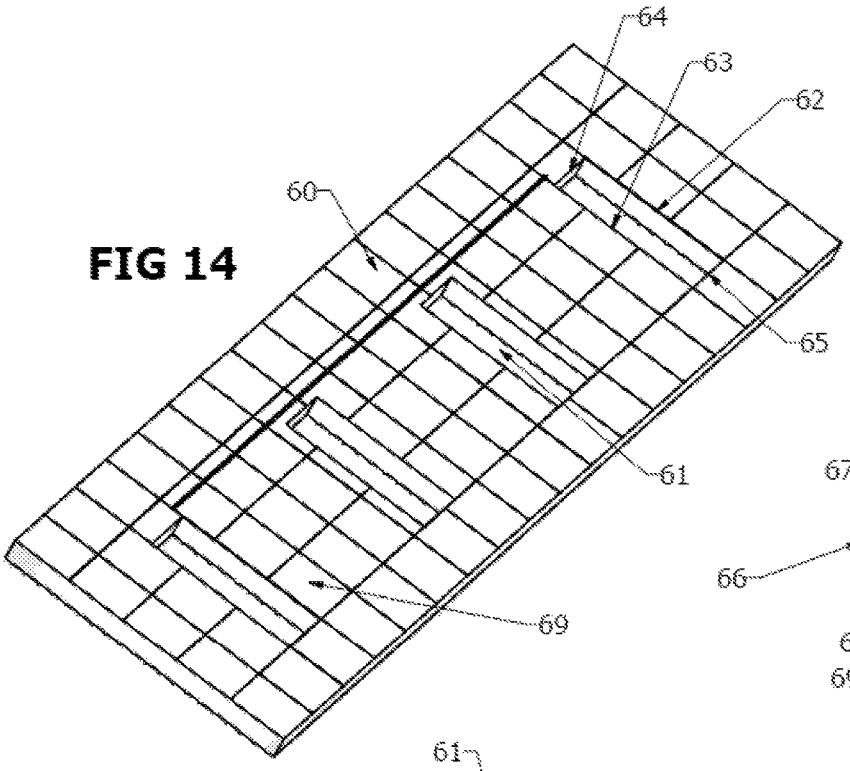
FIG 14
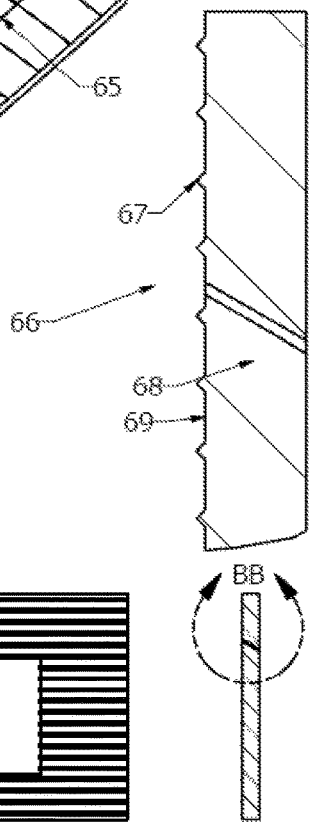
FIG 15
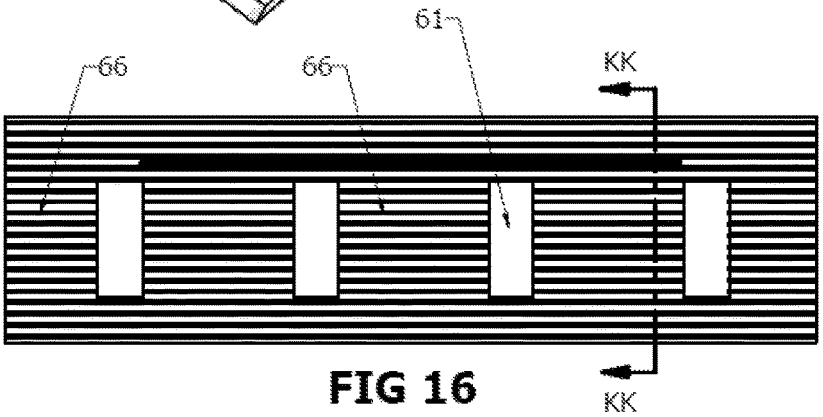
FIG 16
FIG 17

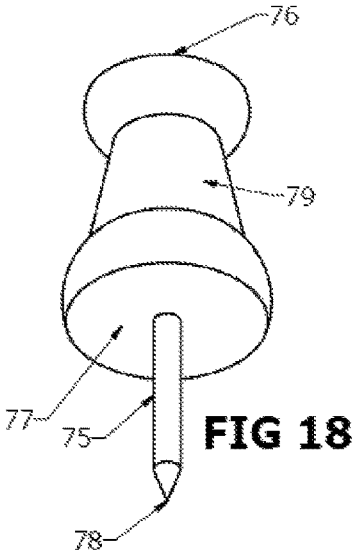
FIG 18
FIG 19
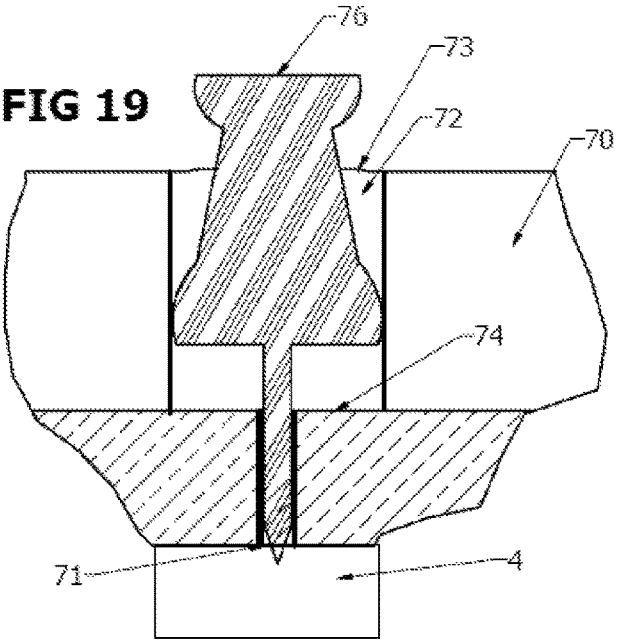
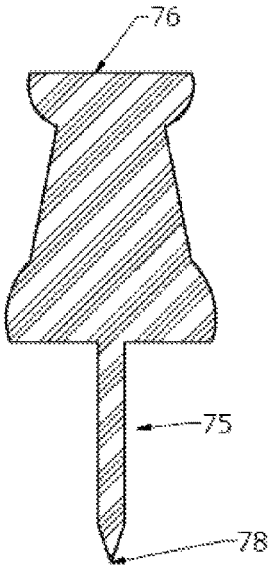
FIG 20
FIG 21
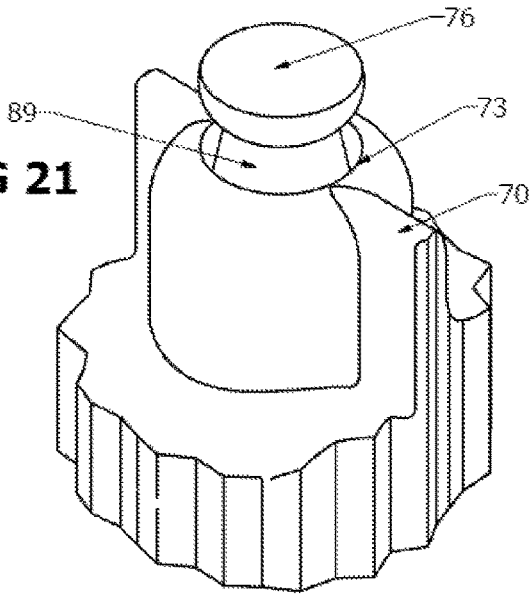

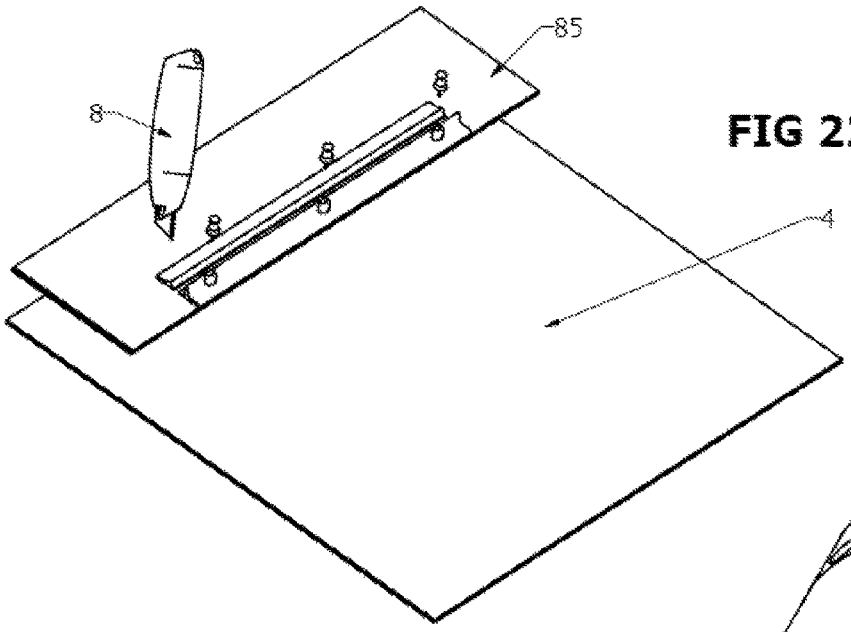
FIG 22
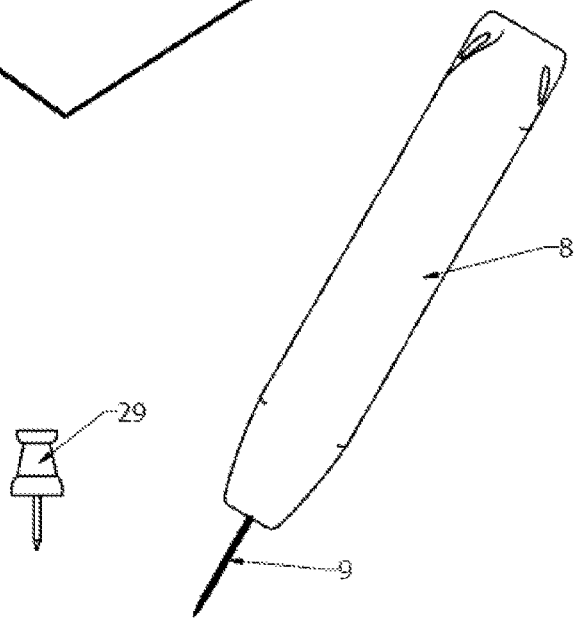
FIG 23
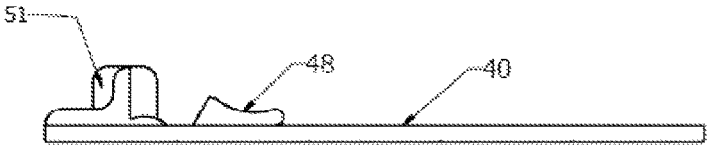

TOOL FOR CONTROLLED CUTTING

The present application is a continuation of U.S. Non-Provisional application Ser. No. 13/200,631, filed Sep. 27, 2011, and further claims priority to U.S. Provisional Application No. 61/404,038, filed Sep. 27, 2010, which are incorporated by reference.

BACKGROUND OF THE INVENTION

1. Field of the Invention

The present invention relates to a template for a cutting tool and, more particularly, to a guide for easily measuring and positioning the template for creating cuts onto a substrate.

2. Description of the Related Art

Various materials, such as, mat board, construction board, foam board, paper and corrugated paper are often cut to size or have cut outs within their borders. Many times determining the location of the cuts is a multi-step process requiring measuring, marking and finally positioning a tool to guide the blade or placing the substrate into a fixture to facilitate cutting.

The practice of creating a mat window within a frame by measuring and cutting out a center section of material such as mat board, foam board, paper and corrugated paper to create a decorative effect for displaying artwork and significant documents of many sorts has been a popular activity throughout history. This practice is performed by people of varying expertise from professional framers to amateur artists and crafters. The prior art devices designed to execute a measured and precise straight or angled cut in the aforementioned materials are either inadequate or expensive and cumbersome. The elements of creating a measured precise straight or angled cut include the ability to concurrently measure the distance of the start of the cut from the upper edge of the workpiece, the length of the cut, and the parallel distance of the cut from the adjacent edge of the workpiece, the ability to stabilize the cutting blade to insure a clean uniform cut, the ability to securely orient the cutting device to the workpiece to avoid the disorientation of the desired cut during execution, and the ability to clearly see the execution of the desired cut throughout the process.

There are a number of devices that attempt to address one or more of these elements as related to the execution of a strait or angled cut, none of which successfully address all of these elements simultaneously at a cost that is universally embraced by the non-professional. It is common practice for users without access to professional mat cutting devices to use a variety of strait edges, rules, and razor knives to approximate this effect. The results of this work around often lack the professional results users seek.

U.S. Pat. No. 6,829,833 (Langman) discloses a guide for steadying the path of a cutting tool consisting of a platen that includes a periphery which bounds a planar surface, used to enable a force to be applied to compress a workpiece on opposing sides of the path of the tool by contacting the upper surface of a workpiece, and another surface spaced apart from the planar surface. The platen includes portions which define the edge of an aperture which connects the surfaces. The edge is displaced from the periphery of the platen and can be engaged by a cutting tool.

The design disclosed by Langman describes an aperture of sufficient width to accommodate the body of an average utility knife allowing the cutting blade to penetrate a thicker compressed material such as insulation. The width of the guide slot disclosed by Langman, however, differs from the disclosed invention and does not contemplate or suggest the use of the cutting guide slot for capturing, directing, and stabilizing the cutting blade.

G.B. Patent. No. 2463746 (Hudson) discloses a tool that has a guide slot extending along the length of an elongate member for receiving a drawing implement. A set of transverse markings is perpendicular to the guide slot, and a set of longitudinal markings is parallel to the guide slot. The transverse markings bisect the guide slot, and the longitudinal markings bisect the transverse markings. The transverse and longitudinal markings are formed on the elongate member by one of etching, embossing and raised detents forming a broken line. The guide slot disclosed by Hudson is designed for use of a drawing implement and does not contemplate or suggest the use of the cutting guide slot for capturing, directing, and stabilizing a cutting blade.

U.S. Patent Application Publication No. 2009/0151531 (Levin) discloses a process for crafting paper and related kit by placing a paper on a cutting surface of a double-sided mat and by placing a ruler (e.g. straight ruler) over the paper, and a cutting blade is positioned within a channel formed in the ruler. The paper is cut with the cutting blade. The paper is provided on a scoring surface of the mat, and the ruler is placed over the paper. A scoring knob is located within the channel in the ruler, and an arch or a circle is scored from the paper by utilizing the scoring knob. The paper is folded about a score line. The process disclosed by Levin, however, does not contemplate or suggest the use of a freehand cutting tool or the use of the cutting guide slot for capturing, directing, and stabilizing the cutting blade.

U.S. Pat. No. 6,854,189 (Schafer) discloses a tool made of a transparent non-static cling flexible sheet comprising multiple sheet segments for measuring, marking, and cutting material. The tool is removably adhered to one of the two planar sides of a transparent rigid sheet. The planar sides of the transparent rigid sheet have multiple lines. The tool disclosed by Shafer is a measuring grid without a cutting guide slot element for directing a cutting blade.

U.S. Patent Application Publication No. 2002/0095804 (Coplan) discloses a sheet material cutting device that includes an elongate base plate with a cutting side edge to guide the knife blade for cutting the sheet. A guard plate extended upward and running parallel and closer to the cutting edge is curved towards the side opposing the cutting edge to guard the hand pressing the base plate onto the sheet. The tool disclosed by Coplan is used for making cuts along an unrestrained edge and does not contemplate or suggest the use of a cutting guide slot for capturing, directing, and stabilizing the cutting blade.

U.S. Pat. No. 5,946,808 (Martinez) discloses a device designed to cut or score floor covering materials such as vinyl, linoleum, carpet and other sheet goods. The device has a metal base with a straight edge located on the front and rear portions of the meal base. Stabilizing members fixed to the top surface of the metal base provide a support for positioning pins which hold the metal base to the carpet. Each stabilizer has a positioning pin including a knob and made to hold the bottom surface of the metal base to the carpet being cut so straight edges of the metal base may not move as the carpet is being cut. A guide track extends the entire length of the base while another guide track is provided to each cutting piece which are of different versions. The device disclosed by Martinez, however, suffers from the inconvenience of requiring the user to screw the positioning pins into the metal base. The device disclosed by Martinez does not contemplate or suggest the use of standard push pins or fasteners for securing the cutting device to a workpiece or the use of the cutting guide slot for capturing, directing, and stabilizing the cutting blade.

U.S. Pat. No. 4,038,751 (Albright) discloses a mat cutting device that includes a cutter for making a bevel cut and an adjustable edge guide having a vertical straight edge surface. A vertical flat surface on the cutter is slidably engaged as the cutter is pushed along the edge guide to make a straight, beveled cut parallel to one edge of the mat. When used to cut an opening in a mat for mounting pictures, the outline of the picture is traced on the back of the mat parallel to the edges. The mat is then secured face down on the edge guide with straight edge surface positioned adjacent and parallel to one traced line. The device disclosed by Albright, however, suffers from requiring the additional steps of measuring and marking the outline of the cut on the back of the workpiece prior the cutting and requires the use of a cutting member made to engage with an edge guide. The device disclosed by Albright also does not contemplate the use of a standard cutting tool such as an razor knife or utility knife. The present invention overcomes the requirement to measure and mark the back of the workpiece by acting as a template guide with vertical and horizontal reference markings allowing the user to measure, orient, and view the cutting line while execute the cut.

What is desired, therefore, is a device to easily measure and orient the template on the workpiece for cutting while at the same time creating a means to direct and stabilize the cutting blade at the desired angle to easily facilitate the cut. It is a further desire to have a template cutting device that utilizes standard utility knives for cutting and does not rely on a custom cutting blade and device. The disclosed invention also benefits from the ability to easily scale at a significantly lower cost for larger workpieces.

BRIEF SUMMARY OF THE INVENTION

Certain exemplary embodiments are described as follows. The present invention may be regarded as a template cutting guide to facilitate the registration and cutting of a workpiece. The template cutting guide includes an elongated body portion having a top face and a bottom face separated by a thickness, a cutting guide slot sized to receive a cutting blade and extending through the thickness of the elongated body. The cutting guide slot is defined by two walls separated by a thickness and connected at a first and second ends. The template cutting guide may include, on at least one face, two sets of guide lines with equidistant spacing where one set of guide lines is running parallel to the cutting guide slot and the second set of guide lines is running perpendicular to the cutting guide slot. The walls of the cutting guide slot may form an acute angle with respect to the bottom face of the template cutting guide to facilitate beveled cuts. The walls of the cutting guide slot may be substantially perpendicular to the bottom face of the template cutting guide to facilitate strait cuts. The template cutting guide may include at least one aperture extending through the thickness of the body and sized to receive a removable fastener for securing the template cutting guide to the workpiece to be cut. The template cutting guide may include an extended ridge upward from the top face and located between the cutting guide slot and the finger holding area of the template cutting guide to serve as a protective ridge between the cutting blade and the fingers of the user's hand used to hold the device in place. The extended ridge may comprise of at least one aperture for receiving removable fasteners to secure the template cutting guide to the workpiece to be cut. The template cutting guide may include a ridge extending from at least one side of the cutting guide slot side wall that may serve to extend the cutting guide. The template cutting guide may include some portion of the bottom face comprising of a nonslip material for frictionally securing the template cutting guide to the workpiece. The elongated body portion of the template cutting guide may be comprised of a substantially transparent material or a nontransparent material having at least one window extending through the thickness of the body and sized to allow viewing of the workpiece. The template cutting guide may include a means for magnifying a cutting path located adjacent to the cutting guide slot allowing the user to clearly view the execution of the cut. The template cutting guide may include a cutting guide slot comprises of a first axis and a second axis perpendicular to the first axis, where the first and second axes are connected at a curved turn.

The present invention also contemplates a method for cutting a workpiece using a template cutting guide having a cutting guide slot and reference marks, comprising: using reference marks on a template cutting guide to register a cutting guide slot on a workpiece, inserting a cutting blade into the cutting guide slot, and using the cutting blade to cut the workpiece. The cutting guide slot may form an acute angle with respect to a top surface of the workpiece to producing a beveled cut. Also the cutting guide slot may be substantially perpendicular to a top surface of the workpiece producing a strait cut.

An important object of this invention is to provide an improved apparatus and means for achieving professional results at a lower cost and with less time and effort when performing the purpose of this design.

These and other objects of the present invention will become readily apparent upon further review of the following specifications and drawings.

BRIEF DESCRIPTION OF THE DRAWINGS

These and other features of the instant device will become clearer with regard to the following description, claims and drawings where:

FIG. 1 illustrates a prior art method of cutting a workpiece with a straight edge.

FIG. 2 illustrates a second prior art method of cutting a workpiece with a typical mat cutting machine.

FIG. 3 is a perspective view of an embodiment of the inventive template cutting guide.

FIG. 4 is an end-view of the template cutting guide of FIG. 3

FIG. 5 is a top view of the template cutting guide of FIG. 3

FIG. 6 is a side view of the template cutting guide of FIG. 3

FIG. 7 is a cross-section the body showing the angled cutting guide slot of the template cutting guide FIG. 3

FIG. 8 is a perspective view of a second embodiment of the invention

FIG. 9 is a top view of FIG. 8

FIG. 10 is an end view of FIG. 8

FIG. 11 is a cross section end view of FIG. 8 with securing pin seated in place FIG. 12 is a cross section end view of FIG. 8 with utility knife fully inserted into blade guide FIG. 13 is an exploded view A-A of the blade aperture slot and extended blade guide FIG. 14 is a perspective view of a third embodiment of the invention FIG. 15. is an exploded view of B-B showing the bottom gripping elements and aperture slot FIG. 16 is a bottom view of FIG. 14

FIG. 17 is a side view of FIG. 14

FIG. 18 is a perspective view of the push pin

FIG. 19 is an exploded cross section view of the push pin pocket of FIG. 8

FIG. 20 is a cross section view of the push pin

FIG. 21 is an exploded view of the finger guard and push pin assembly

FIG. 22 is an exploded view of the workpiece, template guide and utility knife FIG. 23 is side view of FIG. 22 without the workpiece

DETAILED DESCRIPTION OF THE INVENTION

Figure 24:
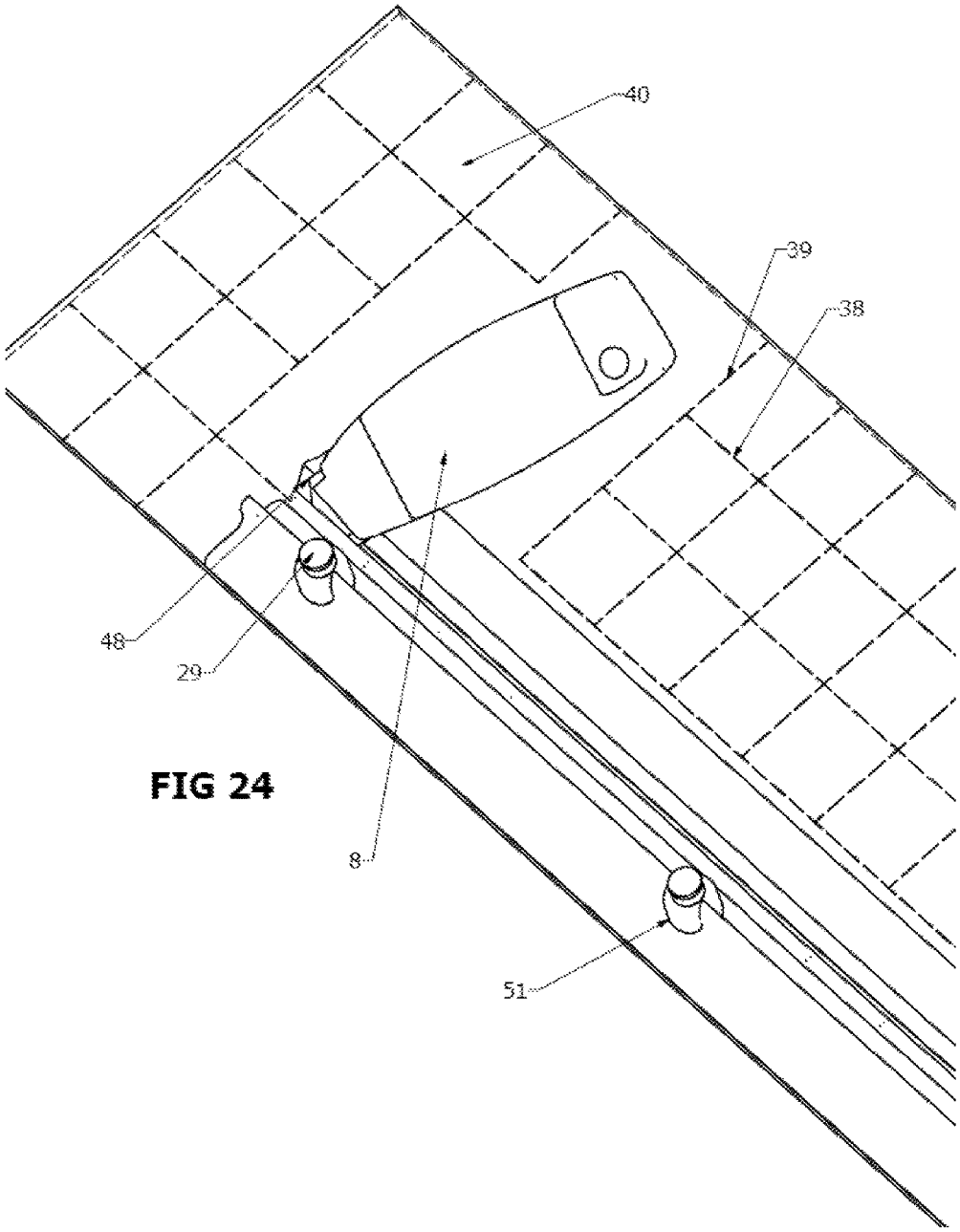
FIG. 24 is a perspective view close up of the utility knife seated in the template blade guide with graphical registration markings

Referring in detail to FIG. 1, a prior art method of using a straight edge assembly 1 and a common cutting tool 8 to a cut workpiece material 4 is shown. Using this apparatus the user holds the straight edge assembly 1 on top of the workpiece 4 and with his free hand grasps cutting tool 8 and cuts workpiece along the single sided cutting edge 7 and cutting path 6.

FIG. 2 illustrates a more intricate prior art cutting assembly 11 used primarily by professionals designed to capture and create precise angled cuts (bevels) in workpiece materials 14 utilizing a dedicated blade cutting tool 15. Referring in detail to FIG. 2, the workpiece 14 is placed in a cutting assembly 11, against the preset rear stop 18 and side adjustable stops 13 set to hold in place and allow a measured offset from the peripheral side edges of the workpiece material 14. The workpiece 14 is secured by the pivoting cutter track 12 closing on and effectively capturing and securing from movement the workpiece 14 between the cutter track 12 and the cutting base 19. Once positioned in the predetermined cut location, the user places the blade at a measured distance from one peripheral side perpendicular to the cutter track 12, simultaneously compressing and pulling the cutter head 15 containing a blade across the cutter track 12 which directs the blade along the cutting path 16 to cut the workpiece 14. An example internal cutout 10, where the user is completing his final of four cuts reveals the rectangular inner cut out 10 mat frame offset created out of the workpiece.

Figure 29:
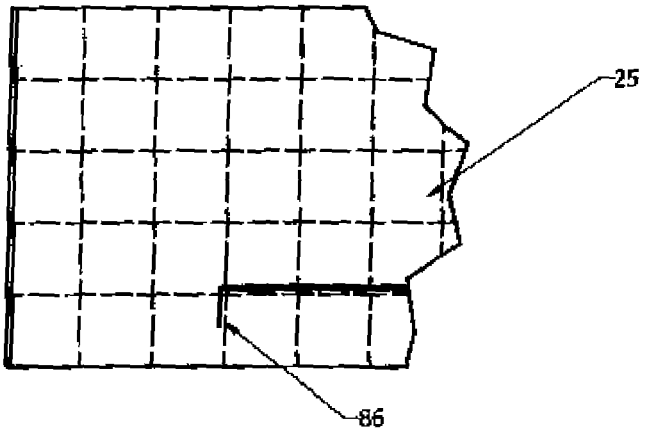
FIG. 29 is a perspective view of an embodiment with a right angle slot

Referring to FIGS. 3, 4, 5, 6, and 7, an exemplary template cutting guide assembly 20 of the present invention comprises, generally, peripheral elongated sides 22 & 23 perpendicular to peripheral short ends 24 & 25. The elongated sides 22 & 23 and short ends 24 & 25 form a rectangular body 21 having a substantially planar first top face surface 26 and opposite bottom face surface 27. It is noted that although the body is shown as a rectangle, it may be any shape that would provide the same elements of this invention. Pin holes 28 may be interspersed along the holding finger area 31 to allow for a push pin 29 to be inserted into the pin hole(s) 28 to secure the template cutting guide 20 to the workpiece 4 to be cut. It is the user's option to use push pins 29 to fasten the template cutting guide 20 to the workpiece 4 or simply hold it in position during cutting. As those skilled in the art would recognize, other types of fasteners such as screws, nails, or staples may also be used to fasten the template cutting guide 20 to the workpiece 4. If desired, a series of longitudinal and latitudinal grid lines 38 & 39 sequentially spaced perpendicular to each other on any area of the template cutting guide 20 may be utilized to measure and register the cutting distance from the peripheral edges of the workpiece 4. A cutting guide slot 30 runs parallel to the long edge of the elongated sides 22 & 23 and perpendicular to the template cutting guide short ends 24 & 25. The cutting guide slot 30 has two parallel side walls 32 & 33 spaced apart sufficiently to guide the cutting blade 9 of a common cutting tool 8 in a precise controlled manner. The guide slot has a top opening 34 and a bottom opening 35. The guide slot may run through the template cutting guide body 21 perpendicular to the top face 26 and bottom face 27 for a straight cut, or it may be angled as shown in FIG. 7 to create an angled bevel cut 80. Portions of the body 21 define the edge of the cutting guide slot 30. This design is not limited to straight cutting guide slots. As seen in FIG. 29 a right angle slot 86 and FIG. 30 a curved slot 87 may also be used.

Prior to cutting, the user determines the amount of offset that he wants to remain after cutting out the window of the workpiece 4. The present invention allows the user to easily register the template cutting guide above the workpiece using the longitudinal and latitudinal grid lines 38 & 39 to measure the desired offset from the start and run of the cutting path 16 to the adjacent peripheral outer edges of the workpiece to be cut. The template cutting guide 20 of this invention is designed to work with any form of grid marking including the use of a substantially transparent body material and marking the longitudinal and latitudinal grid lines 38 & 39 on the bottom of the template cutting guide 20. To use the template cutting guide 20, the user places the planar bottom face surface 27 on to the top surface of the workpiece 4 and orients the template cutting guide by using the longitudinal and latitudinal grid lines 38 & 39 or another means of measuring to measure the required offset. The longitudinal and latitudinal grid lines 38 & 39 are oriented from the location of the angled cut. The user may steady the template cutting guide 20 with one hand, and use his free hand to grasp the cutting tool 8 and place the cutting blade 9 in to the cutting guide slot 30 defined by the cutting slot side walls 32 & 33. Depending on the desired cut the user may use a template cutting guide 20 with a cutting guide slot 30 that runs perpendicular to the face of the workpiece 4 giving a straight cut, or use a template cutting guide 20 with an cutting guide slot 30 that form an acute angle to the face of the workpiece 4 to create a precisely executed beveled cut. This design contemplates the use of a variety of slot angles depending on the slot design chosen for the desired straight or beveled cutting affect.

Continuing the cutting process the user places one hand on the template cutting guide 20 taking care to not cover the slot applying a downward force with his hand onto the top planar surface of the body 21, more specifically on the holding figure area 31, with sufficient effort to prevent the template cutting guide 20 from moving during the cutting process. Optionally the user may pin the template cutting guide 20 onto the workpiece 4 once he has aligned his cutting path 16, the user using a push pin 29 may insert the push pin needle 75 through the push pin hole 28 in the body 21 and driving the push pin tip 78 into surface of the area of the workpiece 4 that is the internal cutout 10 thus mechanically fastening the template cutting guide 20 to the workpiece 4 without damaging the finished work product.

Figure 25:
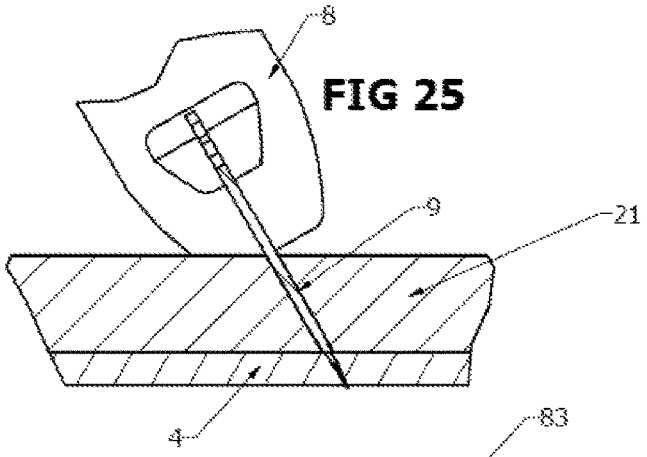
FIG. 25 is a cross section view of the utility knife seated in the blade guide and cutting into the workpiece
Figure 26:
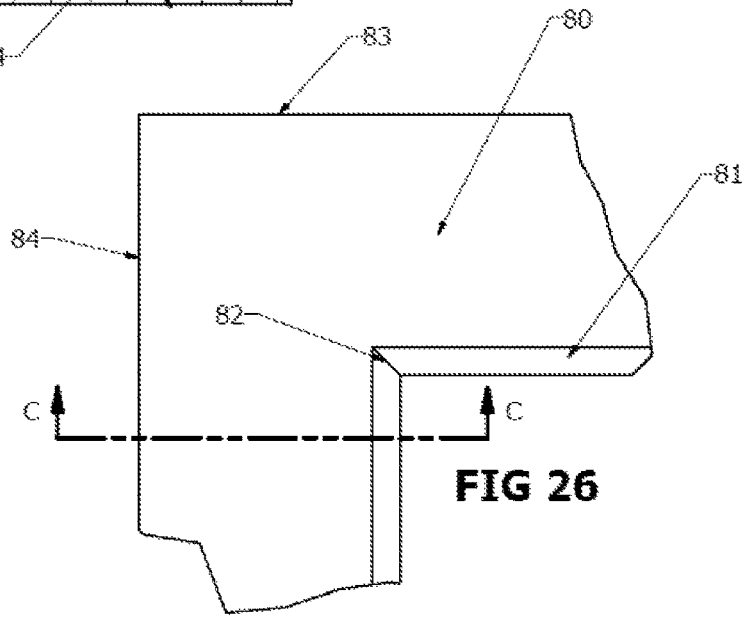
FIG. 26 is a corner section top view of a workpiece with the inner window cut out to create a mat board frame
Figure 27:
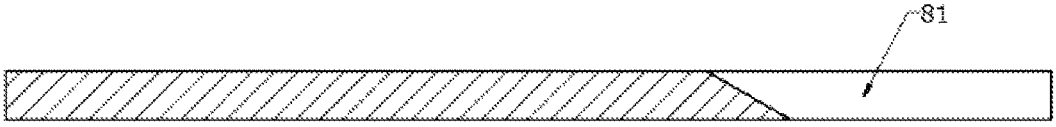
FIG. 27 is a side section view of the beveled edge of the workpiece
Figure 28:
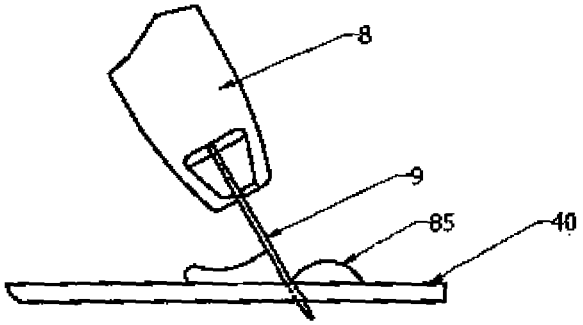
FIG. 28 is a cross section end view of FIG. 8 with the convex lenticular rib

With the free hand the user may grasp the cutting tool 8 and inserts the cutting blade 9 of the cutting tool 8 into the cutting guide slot 30 defined by the slot side walls 32 and 33, slot top opening 34 and bottom opening 35 and so that the cutting blade 9 projects below the slot bottom opening 35 sufficiently deep enough to completely penetrate the workpiece 4 illustrated in FIG. 25. While the width of the cutting blade slot guide 30 need only be sufficiently wide to permit the cutting blade 9 of the cutting tool 8 to be inserted. With the cutting blade 8 of the cutting tool 9 penetrating the material of the workpiece 4, the user may apply a force with his cutting hand and draw the tool within the cutting blade slot guide 30 of the template cutting guide 20 stopping the cut at the desired offset distance. The user may use the longitudinal and latitudinal grid lines 38 & 39 on the template cutting guide 20 to predetermine where he should start and stop his offset cut.

Referring to FIGS. 8, 9, 10, 11, 12, and 13, a second exemplary embodiment of the template cutting guide 40 having similar elements to the first embodiment template cutting guide 20 is shown with an extended cutting guide 48, protruding finger guard 51, and integrated push pin pocket entrance 56 and seat 57. The template cutting guide 40 of the second embodiment of the present invention comprises, generally, a body 41 having peripheral elongated sides 42 & 43 perpendicular to peripheral short ends 44 & 45. The elongated sides 42 & 43 and short ends 44 & 55 form a rectangular body 41 having a substantially planar first top face surface 46 and opposite bottom face surface 47. There are push pin pocket entrances 56 interspersed along the finger guard 51 to allow for a push pin 29 to be inserted into the push pin pocket entrance 56 to secure the template cutting guide assembly 40 to the workpiece 4 to be cut. A detailed description of the push pin action will appear later in the discussion of the design. If desired, a series of longitudinal and latitudinal grid lines 59 sequentially spaced at regular intervals to each other may be utilized to measure and register the cutting distance offset from executed cut and the outside peripheral edges of the workpiece 4.

There is a cutting guide slot 50 that runs parallel to the long edge of the elongated sides 52 & 53 of the body 51 and perpendicular to the template cutting guide short ends 54 & 55 to accept the cutting blade 9 of the cutting tool 8. In this embodiment the angle of the cutting guide slot's 50 interior side wall 53 is extended above the guide slot top opening 55 extending the cutting guide 48 to further direct and secure the blade during cutting. The extended cutting guide area 48 allows the user additional stability when the cutting tool 8 and specifically cutting blade 9 are placed into the cutting guide slot 50. The blade guide ridge 49 acts as a shoulder rest for the cutting tool body during cutting as illustrated in FIG. 12.

The raised ridge of the finger guard 51 runs parallel to the cutting guide slot 50 of the template cutting guide 40 of this embodiment. Having a raised finger guard 51 of this design provides a protected and more secure area for the user to place his fingers during cutting. As can be seen in FIGS. 11, 12, and 13, the raised finger guard not only offers a space for the push pin pockets 72 but creates a physical barrier along the cutting path defined by the cutting guide slot 50 and extended cutting guide surface 48 to protect the user from accidental cutting of his fingers. The raised guides of the finger guard 51 and the extended cutting guide 48 may also serve a structural function in this embodiment by providing integrate ribs running along the longer plane of the template cutting guide if it is desired to reduce the thickness of the planar surface of the template cutting guide defined by the template cutting guide 40 top face 46 and bottom face 47 surfaces.

Referring to FIGS. 14, 15, and 16, a third exemplary embodiment of the template cutting guide 60 is shown with the base elements of embodiment one of the template cutting guide 20 of the present invention. Within the template cutting guide 60 of this embodiment are a series of interspersed windows 61 with side walls 62 & 63 and end walls 64 & 65 forming a rectangular window 61. Windows 61 may be used to view the outer peripheral edges of the workpiece 4 when registering the edges for the desired offset. This third embodiment also has gripping ridges 66 protruding from the bottom of the template cutting guide 60 for enhanced gripping of the workpiece 4 when cutting. The gripping ridges may have a raised peak 67 designed to direct the forces in a point loading mechanical advantage for securing the template cutting guide 60 to the workpiece 4 during cutting. Using this embodiment the user would use the windows 61 to view the workpiece 4 alignment to the series of longitudinal and latitudinal grid lines 69 aligned to the windows 61 for determining the desired offset placement position of the template cutting guide 60 relative to the outer peripheral edge of workpiece 4 for the offset cut. While the windows 61 are shown in a series of multiple rectangles, it is contemplated that the windows may be one small or large window of any shape or plurality.

Referring to FIGS. 18, 19, 20, and 21, none of the embodiments are intended to be defined by the shown push pin design, as one skilled in the art can understand any number of push pin designs may be employed for the purpose of securing the template cutting guide 20, 40, or 60 to the workpiece 4. Thus, it is proposed for this disclosure to use a commonly available push pin design to facilitate this function. FIG. 18 shows a perspective view of one such push pin, having a body 79 and a needle portion 75. The push pin needle 75 has a sharp terminating pin tip 78 to facilitate penetrating the workpiece 4 when securing the template cutting guide 20, 40 or 60 to the workpiece 4. A base section at the push pin bottom 77 of the push pin body 79 acts in this design as a stopping surface when the push pin is inserted and pushed in to the workpiece 4 and in embodiment 2 through the push pin guide pocket 72. As seen in FIG. 21, the push pin guide pocket 72 may be designed to receive the push pin body 79 and allow the push pin needle 75 to pass through a push pin needle guide hole 71 at the bottom of the push pin guide pocket 72. The push pin guide pocket 72 allows the push pin to travel along the wall of the pocket 72 freely and sufficiently to allow the push pin needle 78 to be drawn up into the push pin guide pocket 72 when not activated and travel through the push pin needle guide hole 71 when activated. The push pin guide pocket bottom 74 acts as a stop when the push pin 79 is fully pushed into the workpiece 4. Although this embodiment shows a flat push pin bottom 77 stopping against a flat push pin guide pocket bottom 74 it is contemplated that any number of shapes both with male-female interactions or simply interference stops will similarly work to limit the travel and contain the push pin from extending thought the push pin guide pocket 72. It is also contemplated by this design that the push pin guide may be adapted to capture the push pin within the guide pocket 72 to prevent the push pins from falling out of the push pin guide pocket 72.

Referring to FIGS. 22, 23, 24, 25, 26, 27, and 28, the embodiments of this invention are not meant to be limiting to the exact combination of individual elements described but to be illustrative of the versatility and adaptability of the design to various workpieces 4 and slot angles and sizes of the template cutting guide embodiments 20, 40, 60 & 85. Referring to template cutting guide 85 in FIG. 22, it is apparent that the guide may be scaled and produced in a range of sizes to accommodate different sized workpieces. In addition, the design may utilize any number of commonly available razor knives, utility knives and the like to facilitate the cutting of the workpiece. The only limiting factor is that the apertures described are wide enough to accommodate the cutting blade 9. The advantage of this design may be seen in numerous ways when comparing the invention to the prior art methods of creating a beveled edge cut.

The design of this invention may be made out of any number of materials including plastic, metal and glass. A clear glass plastic material can be utilized in the convex lens shape 85 shown in FIG. 28 that functions to magnify the placement of the cutting blade 9. Also the grid reference markings may be designed to accommodate any number of embodiments based on user needs and preferences for creating the desired cut edges. One preferred embodiment can be seen in FIG. 23 where the template cutting guide template 40 is made of a transparent material and the longitudinal and latitudinal grid lines 38 & 39 are on the bottom face 47 of the body 41 and the user has the ability to see the grid directly on the workpiece 4 for the determination of the orientation and distance of the offset cutting measurement. Additionally the ability to completely see the workpiece 4 under the template cutting guide 40 provides the user the greatest ease of orientating and registering the desired cutting path, with the additional advantage of seeing the actual penetration of the blade point into the workpiece for cutting precision. The present invention also has the advantage over the prior art in that it requires no marking of the workpiece or having to cut from the back of the workpiece.

This preferred embodiment allows for the use of a commonly available cutting tool 8 and commonly available push pins 79 to work with the template cutting guide of this invention. The invention of this disclosure allows the user the ease of use and adaptability of the straight edge 1 of the prior art while providing the utility of creating a straight through (perpendicular to the surface) or a beveled cut of the workpiece that is the result of the more complicated and expensive cutting assembly 11. The invention of this disclosure can create the professional results illustrated in FIG. 26 without the complexity and cost to the user in time and money.

All the references cited herein are incorporated by reference.

The terms and expressions that have been employed in the foregoing specification are used as terms of description and not of limitations, and there is no intention that the invention be limited by the use of the features shown and described or portions thereof. The scope of the invention is defined and limited only by the claims that follow.

Figure 30:
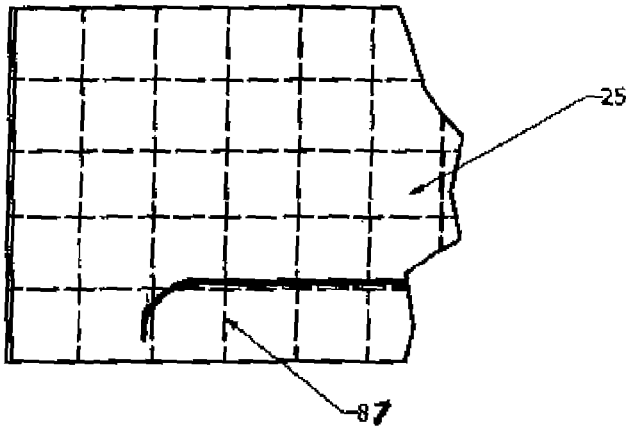
FIG. 30 is a perspective view of an embodiment with a curved slot

Referring to FIGS. 29 and 30, the embodiments of this invention may also include a cutting guide slot with a first axis 20 that terminates at a second axis 86 which is perpendicular to the first axis 20 connected at an angled turn illustrated in FIG. 29. The embodiments of this invention may also include a cutting guild slot 20 with a first axis that terminates at a second axis 87 which is perpendicular to the first axis 20 connected by a curved turn illustrated in FIG. 30.

What is claimed is:

1. A cutting system comprising:

a template cutting guide and a cutting blade;

said template cutting guide having an elongated body portion with a substantially coplanar top face and a bottom face separated by a first thickness, a cutting guide slot extending through said first thickness, said cutting guide slot defined by a first wall and a second wall connected at first and second ends, said first and second walls separated by a second thickness, wherein said first and second walls are substantially parallel, said second thickness is substantially the same as a thickness of said cutting blade and permits movement of said cutting blade along said cutting guide slot, and said first and second walls engage said cutting blade to control the position of said cutting blade during cutting of a workpiece and form an acute angle with respect to said bottom face to facilitate beveled cuts;

wherein said elongated body portion comprises a substantially transparent material through which said cutting blade is visible, and further comprises a first and second plurality of lines formed on at least one of said faces, said first plurality of lines running parallel to a line formed by the intersection of said first wall and one of said faces and having equidistant spacing and said second plurality of lines running perpendicular to said line formed by the intersection of said first wall and said one of said faces and having equidistant spacing, wherein said first and second plurality of lines intersect to form a grid on said one of said faces; and wherein said template cutting guide further comprises an integral guide ridge extending upwardly from said top face, said guide ridge extending parallel to and along the length of said cutting guide slot, said guide ridge comprising a surface continuously extending one of said walls at said acute angle to further engage and support said cutting blade.

2. The system of claim 1 further comprising a fastener, wherein said template cutting guide comprises at least one aperture extending through said first thickness to receive said fastener for securing said template cutting guide to said workpiece to be cut, wherein said aperture is located between said first and second ends, and wherein said aperture has a size and shape that is substantially the same as said fastener and said fastener releasably engages said aperture.

3. The system of claim 1, wherein said template cutting guide further comprises an integral guard ridge extending upwardly from said top face, said guard ridge being located within a cutting guide body portion defined by a second acute angle created by said top face and said cutting guide slot and a proximal edge of said template cutting guide parallel to said cutting guide slot and wherein said guard ridge is further located parallel to said cutting guide slot and further located between said first and second ends.

4. The system of claim 1, wherein said bottom face comprises a nonslip material for frictionally securing said template cutting guide to said workpiece.

5. The system of claim 1, wherein said template cutting guide further comprises a means of magnifying a cutting path through said cutting guide slot, said means for magnifying being located adjacent to said cutting guide slot and further located parallel to said cutting guide slot.

6. The system of claim 1, wherein said cutting guide slot comprises a first axis and a second axis perpendicular to said first axis, and said first and second axes being connected at an angled turn.

7. The system of claim 1, wherein said cutting guide slot comprises a first axis and a second axis perpendicular to said first axis, and said first and second axes being connected at a curved turn.

8. A method for cutting a workpiece with a plurality of outer edges, to form a mat border with predetermined dimensions, the method comprising:

utilizing a cutting blade and a template cutting guide; said template cutting guide having a cutting guide slot and reference lines extending parallel and perpendicular to said cutting guide slot wherein said reference lines intersect forming a grid and wherein said cutting guide slot is defined by a first wall and a second wall connected at first and second ends, said first and second walls separated by a thickness, said thickness is substantially the same as the thickness of said cutting blade and permits movement of said cutting blade along said cutting guide slot, and said first and second walls form an acute angle with respect to a bottom surface of said cutting guide and engage said cutting blade to control the position of said cutting blade during cutting;

placing said template cutting guide on top of said workpiece and utilizing said reference lines to locate said cutting guide slot at a first distance relative to a first outer edge of said workpiece, wherein said first distance corresponds to a first predetermined dimension of said mat border;

inserting said cutting blade into said cutting guide slot, and creating a first beveled cut in said workpiece with said cutting blade along said cutting guide slot to form a first inner edge of a mat window;

repositioning said template cutting guide on top of said workpiece relative to a second outer edge of said workpiece and utilizing said reference lines to locate said cutting guide slot at a second distance relative to a said second outer edge of said workpiece, wherein said second distance corresponds to a second predetermined dimension of said mat border;

inserting said cutting blade into said cutting guide slot, and creating a second beveled cut in said workpiece with said cutting blade along said cutting guide slot to form a second inner edge of said mat window;

repositioning said template cutting guide on top of said workpiece relative to one of said outer edges of said workpiece and utilizing said reference lines to locate said cutting guide slot at a third distance relative to one of said outer edges of said workpiece, wherein said third distance corresponds to a third predetermined dimension of said mat border;

inserting said cutting blade into said cutting guide slot, and creating a third beveled cut in said workpiece with said cutting blade along said cutting guide plot to form a third inner edge of said mat window;

wherein at least said first, second, and third beveled cuts connect to create an inner cut-out mat window offset from said outer edges of said workpiece.

9. The method of claim 8, wherein said template cutting guide further comprises at least one aperture extending through said first thickness and sized to receive a fastener for securing said template cutting guide to said workpiece to be cut, and wherein said aperture has a size and shape that is substantially the same as said fastener and said fastener releasable engages said aperture, and the method further comprises inserting said fastener into said aperture and engages with said workpiece securing said workpiece to said template cutting guide.

* * * * *